US009204495B2

(12) United States Patent
Soerensen et al.

(10) Patent No.: US 9,204,495 B2
(45) Date of Patent: Dec. 1, 2015

(54) HEATING ELEMENT WITH TEMPERATURE SENSOR

(75) Inventors: Olaf Soerensen, Mainz (DE); Juergen Seng, Kelkheim (DE); Christoph Schmitz, Langgoens (DE); Francis Pinto, Oberursel (DE)

(73) Assignee: The Procter & Gamble Company, Cincinnati, OH (US)

( * ) Notice: Subject to any disclaimer, the term of this patent is extended or adjusted under 35 U.S.C. 154(b) by 551 days.

(21) Appl. No.: 12/892,276

(22) Filed: Sep. 28, 2010

(65) Prior Publication Data

US 2011/0011847 A1 Jan. 20, 2011

Related U.S. Application Data

(63) Continuation of application No. PCT/EP2009/002160, filed on Mar. 25, 2009.

(30) Foreign Application Priority Data

Mar. 28, 2008 (EP) ..... 08005925

(51) Int. Cl.
*H05B 3/10* (2006.01)
*A45D 1/04* (2006.01)
(Continued)

(52) U.S. Cl.
CPC ..... *H05B 3/146* (2013.01); *H05B 3/26* (2013.01); *H05B 2203/011* (2013.01);
(Continued)

(58) Field of Classification Search
CPC .... H05B 2/26; H05B 2/146; H05B 2203/011; H05B 2203/013; H05B 2203/017; H05B 2203/021; H05B 2203/028; H05B 2203/029; H05B 2203/036
USPC ..... 219/538, 539, 540, 541, 543, 553, 222, 219/225, 201, 243, 245, 250, 254, 524, 530, 219/542
See application file for complete search history.

(56) References Cited

U.S. PATENT DOCUMENTS 4,286,377 A 9/1981 Hurko
4,302,663 A 11/1981 Chesnut et al.
(Continued)

FOREIGN PATENT DOCUMENTS

DE 1515023 11/1969
EP 0585015 3/1994
(Continued)

OTHER PUBLICATIONS

European Search Report completed Jul. 18, 2008, 2 pages.

*Primary Examiner* — Dana Ross
*Assistant Examiner* — Lindsey C Teaters
(74) *Attorney, Agent, or Firm* — James C Vago

(57) ABSTRACT

The present invention concerns: A heating element comprising a heating unit, a heat transfer unit and a temperature sensor unit, the heating, unit comprising a first composition, the first composition comprising an epoxy-based or glass-based composition or a composition comprising a sol-gel solution in which up to about 90% of said solution is a conductive powder in a uniform stable dispersion and said solution conductive powder is a member selected from the group consisting of metals, ceramics, interceramics and semi-conductors and the temperature sensor comprising a second composition, the second composition comprising an epoxy-based or glass-based composition or a composition comprising a composition comprising a sol-gel solution in which up to about 90% of said solution is a conductive powder in a uniform stable dispersion and said solution conductive powder is a member selected from the group consisting of metals, ceramics, interceramics and semi-conductors, the heating unit and the temperature sensor unit being provided as two units, which are electrically insulated from each other and with are mechanically supported by the heat transfer unit. The invention also relates to a method of heating an appliance and to a method of providing a heating element.

10 Claims, 4 Drawing Sheets

(51) Int. Cl.

| | |
|---|---|
| ***A45D 2/36*** | (2006.01) |
| ***A45D 4/06*** | (2006.01) |
| ***A45D 4/12*** | (2006.01) |
| ***H05B 3/14*** | (2006.01) |
| ***H05B 3/26*** | (2006.01) |

(52) U.S. Cl.

CPC .... *H05B 2203/013* (2013.01); *H05B 2203/017* (2013.01); *H05B 2203/021* (2013.01); *H05B 2203/028* (2013.01); *H05B 2203/029* (2013.01); *H05B 2203/036* (2013.01)

(56) References Cited

U.S. PATENT DOCUMENTS

| | | | | |
|---|---|---|---|---|
| 4,692,596 | A | 9/1987 | Payne | |
| 4,859,835 | A | 8/1989 | Balderson | |
| 5,177,341 | A | 1/1993 | Balderson | |
| 5,354,967 | A | 10/1994 | Barzilai et al. | |
| 5,422,461 | A | 6/1995 | Weiss et al. | |
| 5,504,305 | A | 4/1996 | Fischer et al. | |
| 5,861,610 | A | 1/1999 | Weiss et al. | |
| 6,046,438 | A | 4/2000 | Slegt | |
| 6,483,085 | B1 | 11/2002 | Milanesi et al. | |
| 6,736,997 | B2 | 5/2004 | Olding | |
| 6,914,217 | B2 * | 7/2005 | Fristedt | 219/217 |
| 6,989,514 | B2 | 1/2006 | Patterson | |
| 7,221,862 | B1 | 5/2007 | Miller et al. | |
| 8,049,145 | B1 | 11/2011 | Walker et al. | |
| 2002/0127035 | A1 | 9/2002 | Otsuka | |
| 2002/0148827 | A1 * | 10/2002 | Watanabe et al. | 219/544 |
| 2006/0237421 | A1 * | 10/2006 | Lee et al. | 219/388 |
| 2009/0044823 | A1 * | 2/2009 | Overend et al. | 132/211 |
| 2009/0114639 | A1 * | 5/2009 | Werkman et al. | 219/543 |
| 2009/0159093 | A1 * | 6/2009 | Yu | 132/211 |
| 2011/0011846 | A1 | 1/2011 | Soerensen et al. | |

FOREIGN PATENT DOCUMENTS

| | | |
|---|---|---|
| EP | 1370497 | 8/2007 |
| GB | 2340713 | 2/2000 |
| JP | 51-099340 | 2/1975 |
| JP | 63248085 | 2/1987 |
| JP | 63252380 | 2/1987 |
| JP | 63146376 | 6/1988 |
| JP | 08115782 | 10/1994 |
| JP | 10012359 | 6/1996 |
| JP | 10112377 | 4/1998 |
| RU | 2071886 | 1/1997 |
| RU | 2260926 | 9/2005 |
| WO | WO02072495 | 9/2002 |
| WO | WO2007131271 | 11/2007 |

* cited by examiner

HEATING ELEMENT WITH TEMPERATURE SENSOR

CROSS REFERENCE TO RELATED APPLICATIONS

This application is a continuation of prior co-pending International Application No. PCT/EP2009/002160 filed Mar. 25, 2009, designating the United States.

FIELD OF THE INVENTION

The present invention concerns a heating element, which comprises a heating unit, a heat transfer unit and a temperature sensor. Heating units have proven useful in a large variety of applications. The heating units disclosed herein can for example be useful in ovens and other kitchen appliance, including in food warmers, water heaters, water kettles and coffee makers or toasters. They are also useful in other household appliances, including clothes dryers, irons, or hair dryers, hair straighteners or hair curlers. Other applications of the present invention include automotive applications and appliances, including car heaters, engine heaters, defrosters, and seat warmers. Yet other applications include reactor heaters and pipe heaters, and similar applications in the chemical engineering area.

BACKGROUND OF THE INVENTION

DE 1515023 discloses a conventional heating system. A piece of suitable wire is wound up as to form a coil around heat stable core material. The unit is sandwiched between further heat resistive layers.

The respective unit is then normally placed into a heat transfer block, for example an aluminium block. In the case of an iron the block can provide the sole of the iron. Pressure is normally applied as to make sure that a good thermal contact between the internal resistive heating element and the surrounding aluminium block is made. A conventional temperature sensor, in the form of a NTC-unit, is often arranged next to or inside the heat transfer block and held in position using a heat resistive foil.

WO 2007/131271 A1 discloses an improved temperature sensor for an electric heating vessel. The temperature sensor can be an electronic heating sensor being thermally insulated from the heat distribution plate, but in thermal communication with the contact plate.

EP 1 370 497 B1 discloses a sol-gel derived resistive and conductive coating. Disclosed is in particular a composition for application to a substrate to form a coating thereon, the composition comprising a sol-gel solution in which up to about 90% of said solution is a conductive powder.

In view of the prior art the present invention aims at providing an optimized heating element, which comprises a heating unit, a heat transfer unit, and a temperature sensor. It is desired that the unit can be manufactured efficiently in a low-cost mass production process and that the temperature sensor is provided in a form optimized for such process and at the same time efficient for accurate and reliable temperature measurement.

SUMMARY OF THE INVENTION

A heating element comprising a heating unit, a heat transfer unit and a temperature sensor unit, the heating unit comprising a first composition, the first composition comprising an epoxy-based or glass-based composition or a composition comprising a sol-gel solution in which up to about 90% of said solution is a conductive powder in a uniform stable dispersion and said solution conductive powder is a member selected from the group consisting of metals, ceramics, interceramics and semi-conductors and the temperature sensor comprising a second composition, the second composition comprising an epoxy-based or glass-based composition or a composition comprising a composition comprising a sol-gel solution in which up to about 90% of said solution is a conductive powder in a uniform stable dispersion and said solution conductive powder is a member selected from the group consisting of metals, ceramics, interceramics and semi-conductors, the heating unit and the temperature sensor unit being provided as two units, which are electrically insulated from each other and with are mechanically supported by the heat transfer unit. The invention also relates to a method of heating an appliance and to a method of providing a heating element.

BRIEF DESCRIPTION OF THE DRAWINGS

Embodiments of the present invention will be described below also with reference to the accompanying drawings in which.

DETAILED DESCRIPTION OF INVENTION

Figure 1:
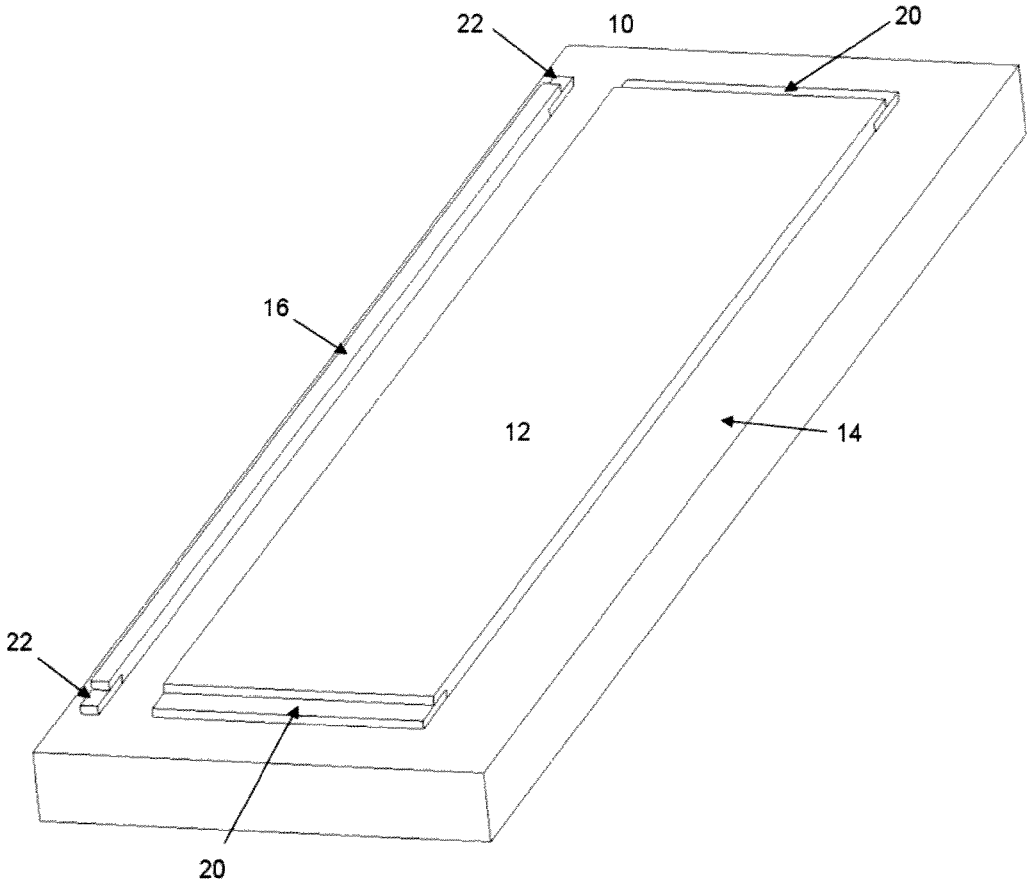
FIG. 1 is a perspective view onto a heating element according to the present invention.

According to the present invention a heating element (10) is provided comprising a heating unit (2) and a heating transfer unit (14) and further at least one temperature sensor unit (16).

The heating unit is the source of heat, and is typically provided as a resistive heater. The heating unit (12) can comprise an epoxy-based or glass-based composition. The unit may also consist of an epoxy-based or glass-based composition.

Alternatively, the heating unit (12) can comprise a composition comprising a sol-gel solution in which in up to 90% of said solution is a conductive powder in a uniform stable dispersion and said solution conductive powder is a member selected from the group consisting of metals, ceramics, interceramics and semi-conductors and the temperature sensor comprising an epoxy-based of glass-based composition or a composition comprising a composition comprising a sol-gel solution in which up to about 90% of said solution is a conductive powder in a uniform stable dispersion and said solution conductive powder is a member selected from the group consisting of metals, ceramics, interceramics and semi-conductors. Some suitable examples of those compositions can be found in EP 1 370 497 B1.

The heating element (10) further comprises a temperature sensor. The temperature sensor can comprise epoxy-based or glass-based composition.

Alternative compositions suitable for the heating unit (12) and/or the at least one temperature sensor unit (16) are sol-gel formulations comprising a slurry having up to 90% by weight of inorganic powder dispersed in a colloidal sol-gel solution prepared from metal organic precursors wherein the sol-gel solution has an expanded and preferably discontinuous gel network and the slurry or coating layer converts to a thick inorganic coating upon firing to a temperature of at least 300° C. and preferably less than 450° C.

Yet alternative compositions suitable for the heating unit (12) and/or the at least one temperature sensor unit (16) are: conductive, resistive and dielectric inks, cermets (prepared from aluminium oxides or zirconium oxides in combination with metals (including niobium, molybdenum, titanium, and chromium)); mixtures of silver, lead, palladium, and ruthenium oxide, for example Ag Pb Pd RuO2, or Pb2Ru2O6, or Ag/Pd 65/35; alumina or aluminium nitride; or mixtures of aluminium oxide, aluminium nitride, beryllium oxide, silicon carbide, and nichrome.

According to the present invention a heating element (10) can have a heating unit (12) and a temperature sensor unit (16) which both comprise the same composition.

The heating element (10) can also comprise a heating unit and a temperature sensor unit (16), which essentially consist of the same composition.

A heating element (10) can have a heating unit (12) and a temperature sensor unit (16) which are both provided as coatings on the heat transfer unit (14).

A heating element (10) can be provided, in which the heating unit (12) and the temperature sensor unit (16) are both provided on one surface of the heat transfer unit (14). For example, as shown in FIGS. 1 to 4 both units can be provided on the top surface of the heat transfer unit (14). Any other surface of the heat transfer unit (14) is equally suitable.

Alternatively the heating unit (12) and the temperature sensor unit (16) are provided onto different surfaces of the heat transfer unit (14). These surfaces can be for example two adjacent surfaces.

The heating element (10) can also comprise a second temperature sensor unit (18).

When a second temperature sensor is provided the two temperature sensor units (16, 18) can be provided on two opposing sides of the heating unit (12).

The heating element (10) can be used for low voltage applications, for example the voltage to operate the heating unit (12) can be chosen in the range of 1 to 250 V, or 200 to 250 V, or 90 to 120 V, or to 50 V, or 10 to 14 V. The heating element (10) has been found to operate very satisfactorily when operated at a voltage in the range of 0 to 50 V or 30 to 50 V or 35 to 45 V. Without wishing to be bound by theory, it is considered possible, that such voltage range allows a sufficiently fast heating without that heating power is such, that the temperature reading becomes less reliable.

Therefore, in one aspect, the present invention comprises: A method of heating an appliance by using a heating element (10) comprising a heating unit (12), a heat transfer unit (14) and a temperature sensor unit (16), the heating unit (12) comprising a first composition, the first composition comprising an epoxy-based or glass-based composition or a composition comprising a sol-gel solution in which up to about 90% of said solution is a conductive powder in a uniform stable dispersion and said solution conductive powder is a member selected from the group consisting of metals, ceramics, interceramics and semi-conductors and the temperature sensor comprising a second composition, the second composition comprising an epoxy-based or glass-based composition or a composition comprising a composition comprising a sol-gel solution in which up to about 90% of said solution is a conductive powder in a uniform stable dispersion and said solution conductive powder is a member selected from the group consisting of metals, ceramics, interceramics and semi-conductors, the heating unit and the temperature sensor unit being provided as two units, which are electrically insulated from each other and with are mechanically supported by the heat transfer unit, wherein the heating unit (12) is operated at a voltage in the range of 30 V to 50 V.

The heat transfer unit (14) is in thermal contact with the heating unit and able to transfer and disseminate heat. The heat transfer unit may also give mechanical stability to the overall heating element. The heat transfer unit (14) can have a multitude of shapes and can be provided from a multitude of materials. For example a cubic or rhombic shape is suitable for the heat transfer unit. Also can the heat transfer unit have a cylindrical or semi-cylindrical shape. A variety of materials with good heat transfer is suitable for the heat transfer unit (14). The heat transfer unit (14) will often be provided from a metal, such as aluminium or from mica-based material. At least one surface of the heat transfer unit (14) can have a coating, for example a ceramic coating or an aluminium oxide coating.

Where the heat transfer unit (14) is provided from an electrically conductive material an electrical insulator can be placed between the heat transfer unit (14) and the heating unit (12) and the at least one temperature sensor unit (16), respectively. Such an electrical insulator can be provided in the form of a coating on at least one surface of the heat transfer unit (14).

In another aspect the present invention comprises a method for providing a heating element (10). The method comprises a step of providing a heat transfer unit (14). Suitable heat transfer units are mentioned above. As a further step a first composition comprising an epoxy-based of glass-based composition or a composition comprising a sol-gel solution as specified above is applied to form a heating unit. In a further step a second composition is applied to form a temperature unit. The second composition can comprise an epoxy-based or glass-based composition or a composition comprising a sol-gel as specified above.

The second composition can be applied at the same time as the first composition is applied. This gives a very fast and efficient process of providing a heating element (10).

Alternatively the second composition can be applied after the first composition, and thereby in a separate step.

Suitable methods for applying the first and/or the second composition are any known methods suitable for this specific composition chosen. These methods include spraying, brushing, dipping or screen-printing.

Such method allows providing a heating element (10) and a temperature sensor unit (16) in an efficient way. There are important process advantages, in using the same or a similar composition for providing both units.

FIG. 1 shows a heating element (10) for which the heat transfer unit (14) is provided in form of a cuboid. One large surface of the cuboid is used for the heating unit (12) and for providing a temperature sensor (16). Both units are provided as coatings carried by the heat transfer unit (14). Both units in themselves also have (at least essentially) the form of a cuboid. In the corresponding on top view of FIG. 2 the heating unit appears as a rectangle with a major axis and a minor axis. The temperature sensor unit (16) is disposed adjacent to the heating unit (12) and also in the form of a rectangle. The rectangle has a major axis, which is as long as the corresponding axis of the heating unit. The temperature sensor unit (16) has a minor axis which is shorter than the minor axis of the heating unit.

The respective minor axis can measure 50%, or 25% or 10% or less of the corresponding axis of the heating unit (12).

Figure 2:
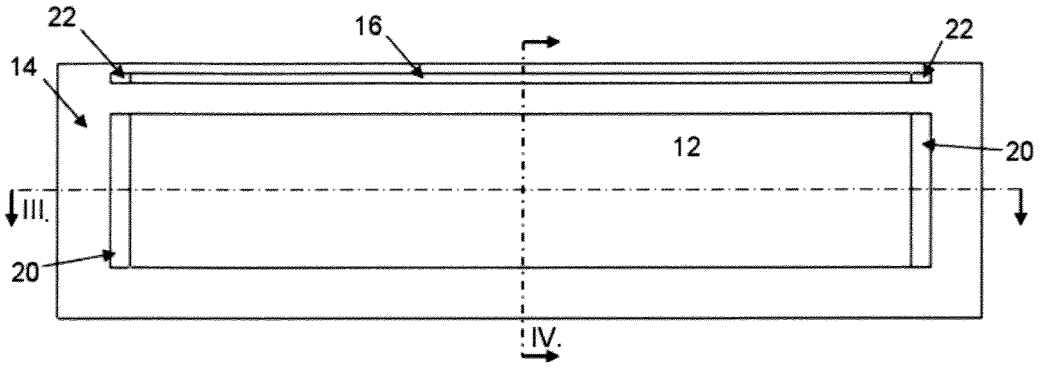
FIG. 2 is an on top view onto the heating element of FIG. 1.

Heating electrodes (20) are provided as to electrically contact the heating unit (12). As shown in FIGS. 1 and 2, these electrodes can be provided adjacent to each of the minor axes of the heating unit (12). They can be provided in the form of a layer of conductive material, e.g. between the heating unit (12) and the heat transfer unit (14).

Further electrodes (22) are provided as to electrically contact the temperature sensor unit (16).

Figure 3:
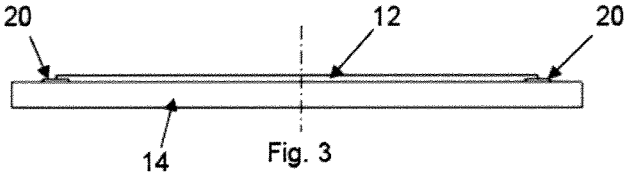
FIG. 3 is across sectional view through the heating element of FIG. 1 along the axis III-III indicated in FIG. 1.

FIG. 3 provides across sectional view of the heating element (10). It is apparent from FIG. 2 that the surface area of the heat transfer unit is only partly covered by the heating unit (12).

Figure 4:
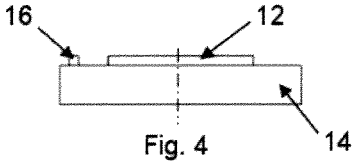
FIG. 4 is another cross sectional view of the embodiment of FIG. 1 along the axis IV-IV indicated in FIG. 1.

FIG. 4 gives another cross sectional view, from which it is apparent that the temperature sensor can be disposed adjacent to the heating unit (12) on one surface of the heat transfer unit. The distance of the temperature sensor unit (16) to the heating unit can be chosen to the about 50%, or 25%, or 10%, or less of the length of the minor axis of the heating unit (12).

Figure 5:
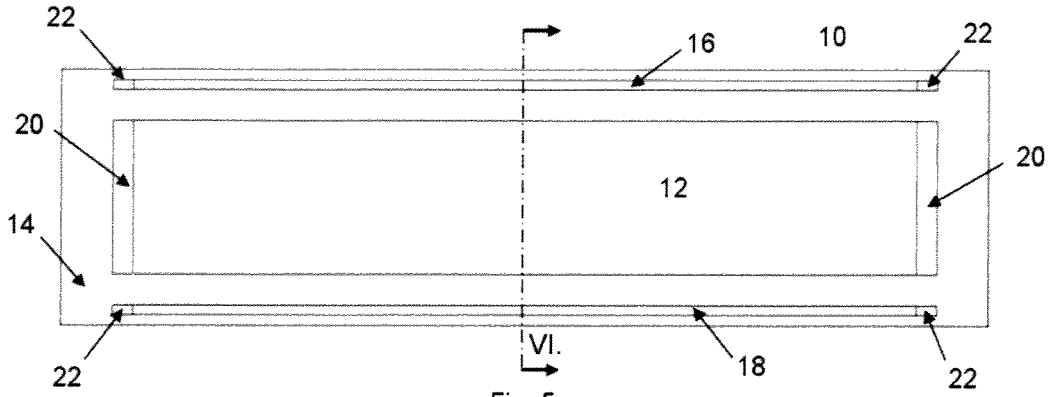
FIG. 5 is an on top view onto another embodiment of the present invention.

FIG. 5 shows an alternative embodiment of heating element (10). In this embodiment a first temperature sensor unit (16) and a second temperature sensor unit (18) are provided on either side of the heating unit (12).

Figure 6:
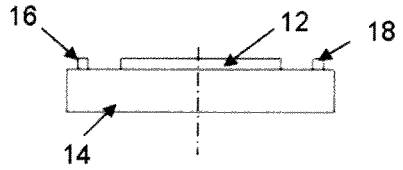
FIG. 6 is a cross sectional view along the axis VI-VI indicated in FIG. 5.

FIG. 6 shows across section corresponding to the cross section of FIG. 3 through the alternative embodiment of FIG. 5.

Figure 7:
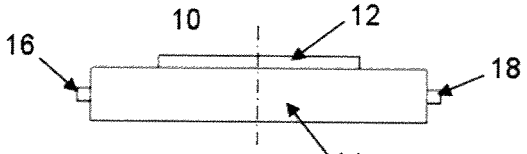
FIG. 7 is a cross sectional view corresponding to the cross sections shown in FIGS. 4 and 6, but of a different embodiment of the present invention.

FIG. 7 shows an alternative embodiment of heating element (10). In this embodiment the heat transfer unit has the shape of a cuboid. The heating unit is placed on its top surface and the two temperature sensor units (16, 18) are arranged on two opposing side surface, which are both adjacent to the top surface.

Figure 8:
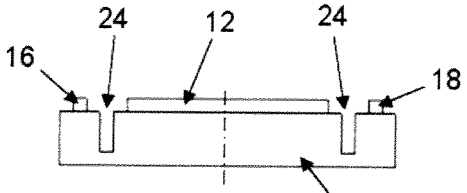
FIG. 8 is a cross sectional view corresponding to the cross sections shown in FIGS. 4 and 6, but of a different embodiment of the present invention.

FIG. 8 shows an alternative embodiment of heating element (10). In this embodiment the heating unit and the two temperature sensor units (16, 18) are arranged as shown in FIG. 5. The heat transfer unit (14) differs from the other heat transfer units shown by having notches (24) between the heating unit (12) and the temperature sensor units (16, 18). These notches (24) reduce the heat transfer between the heating unit (12) and the temperature sensor units. This effect can also be achieved by other physical configurations which provide a lesser amount of heat transfer unit material between at least one temperature sensor unit and the heating unit (12), e.g. a thinning, abridge or the like. Any such configuration is within the scope of the present invention.

It is also within the scope of the present invention to provide a multi-piece heat transfer unit (14). For example, a three-piece-unit can be provided, in which one piece carries the heating unit (12) and the two other pieces each carry a temperature sensor unit. These units can be mounted together, e.g. adhered or clamped, as to achieve a good physical connection without having a strong thermal communication.

A weaker thermal communication between the heating unit and the at least one temperature sensor unit will yield a temperature reading which is more representative of the average temperature of the heat transfer unit (14) and/or the heating element (10) as a whole than of the temperature at the heating unit (12) itself.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A method for straightening hair, said method comprising contacting hair with a heated hair straightening appliance comprising:

(a) a heating unit having a temperature above room temperature;

(b) a heat transfer unit;

(c) a first temperature sensor unit; and (d) a second temperature sensor unit;

(e) an electrical insulator disposed between the heating unit and the first and second temperature sensor units;

and wherein further the heating unit, first temperature sensor unit and second temperature sensor unit are mechanically supported by the heat transfer unit.

2. The method for straightening hair according to claim 1 wherein the hair straightener appliance comprises the first and second temperature sensor units which are on opposing sides of the heating unit.

3. The method for straightening hair according to claim 2 wherein the hair straightener appliance comprises the heating unit, the first temperature sensor unit, and the second temperature sensor unit which are all provided on the same surface of the heat transfer unit.

4. The method for straightening hair according to claim 3 wherein the heat transfer unit comprises notches between the heating unit and the first and second temperature sensor units.

5. The method for straightening hair according to claim 1 wherein the hair straightener appliance comprises the first temperature sensor unit and the second temperature sensor unit which are the same distance from the heating unit.

6. The method for straightening hair according to claim 5 wherein the first and second temperature sensor units are on opposing sides of the heating unit.

7. The method for straightening hair according to claim 6 wherein the heating unit, the first temperature sensor unit, and the second temperature sensor unit are all provided on the same surface of the heat transfer unit.

8. The method for straightening hair according to claim 7 wherein the heating unit is rectangular shaped having a minor and a major axis, and wherein further the distance of the first and second temperature sensor units to the heating unit is 25% or less of the length of the minor axis of the heating unit.

9. The method for straightening hair according to 8 wherein the heat transfer unit comprises notches between the heating unit and the first and second temperature sensor units.

10. The method for straightening hair according to claim 9 wherein the hair straightener appliance comprises a heat transfer unit comprising aluminum and a coating made from ceramic or aluminum oxide.

* * * * *